US005885068A

United States Patent [19]

Döbbeling et al.

[11] Patent Number: 5,885,068

[45] Date of Patent: Mar. 23, 1999

[54] COMBUSTION CHAMBER

[75] Inventors: Klaus Döbbeling, Windisch; Timothy Griffin, Ennetbaden; Hans Peter Knöpfel, Besenbüven, all of Switzerland

[73] Assignee: ABB Research Ltd., Zurich, Switzerland

[21] Appl. No.: 828,540

[22] Filed: Mar. 31, 1997

[30] Foreign Application Priority Data

Apr. 9, 1996 [DE] Germany ..... 196 14 001.3

[51] Int. Cl.[6] ..... F23C 5/00

[52] U.S. Cl. ..... 431/116; 431/174; 431/285; 60/746; 60/737; 60/750

[58] Field of Search ..... 60/737, 746, 750; 431/115, 174, 116, 177, 285

[56] References Cited

U.S. PATENT DOCUMENTS

| | | | |
|---|---|---|---|
| 4,062,182 | 12/1977 | Fehler et al. | 60/737 |
| 4,395,223 | 7/1983 | Okigami et al. | 60/746 |
| 5,359,847 | 11/1994 | Pillsbury et al. . | |
| 5,638,682 | 6/1997 | Joshi et al. | 60/737 |

FOREIGN PATENT DOCUMENTS

| | | |
|---|---|---|
| 0321809B1 | 6/1989 | European Pat. Off. . |
| 3432971C2 | 3/1985 | Germany . |
| 4408136A1 | 9/1995 | Germany . |

*Primary Examiner*—Carroll Dority
*Attorney, Agent, or Firm*—Burns, Doane, Swecker & Mathis, L.L.P.

[57] ABSTRACT

In a combustion chamber of a gas-turbine group which essentially comprises a mixing section (2) for premixing an air/fuel mixture (16) and a downstream combustion space (3), a jump (5) in cross section is provided at the transition between the two said flow sections (2/3). This jump (5) in cross section induces the cross section of flow of the combustion space (3) and at the same time forms outer recirculation zones (10) in the combustion space (3). Flow passages (4) branch off in the end phase of the mixing section (2), which flow passages (4) then lead into the outer recirculation zones (10). A portion (9) of the air/fuel mixture flows out of the mixing section (2) through these flow passages (4) and into the outer recirculation zones (10), the portion being enriched here with an additional fuel (6). This fuel (6) is introduced via a circular line (19) provided with bores (18). The branched off mixture (9) constitutes a self-igniting pilot flame in the outer recirculation zones (10), which pilot flame substantially stabilizes the flame front (20).

10 Claims, 1 Drawing Sheet

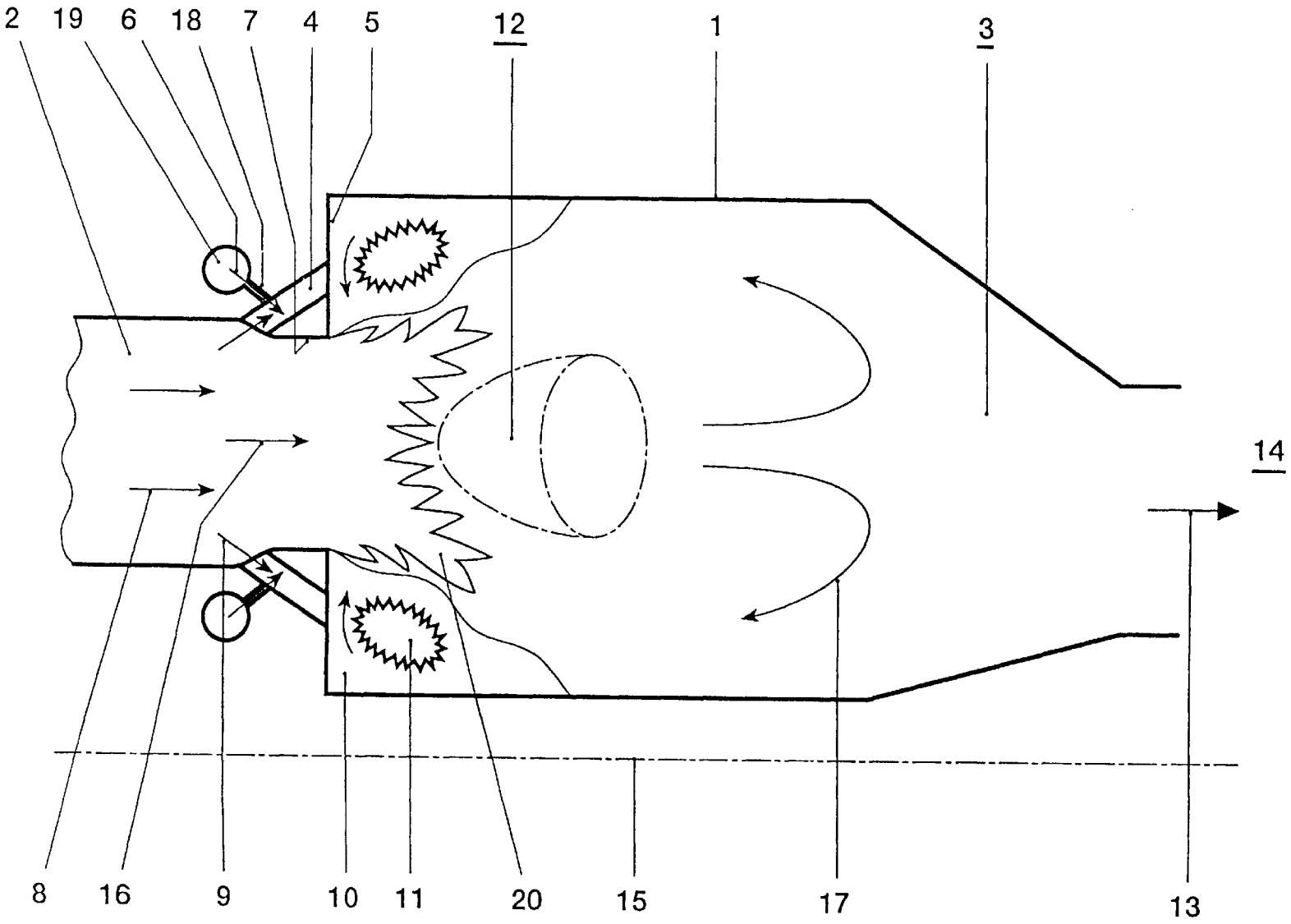
14
3
1
12
5
4
7
18
6
19
2
13
17
15
20
11
10
9
16
8

COMBUSTION CHAMBER

BACKGROUND OF THE INVENTION

1. Field the Invention

The present invention relates to a combustion chamber having fuel/air premixing.

2. Discussion of Background

In modern combustion chambers of gas turbines, premix burners which can be operated on a lean mixture are used in order to limit to a minimum the pollutant components, in particular NOx and CO, arising from the combustion. In principle, it is nowadays assumed that very low NOx emission values, below 10 vppm at 15% O2, must be ensured even at very high flame temperatures. In order to be able to achieve such low pollutant emissions during the operation of a gas turbine over a load range of about 40–100%, a perfectly premixed burner has to be ensured over a wide flame-temperature range, typically about 1650°–1850° K. Such burners are characterized in that a conventional air/fuel premix section is followed by a combustion chamber whose cross section of flow is several times larger than the outlet cross section of the mixing section as a result of an essentially immediate jump in cross section. As a result of this configuration, outer recirculation zones form in the combustion chamber in the region of the plane of this transition, which recirculation zones in fact induce stabilization of the premix flame. However, the stabilizing effect of these recirculation zones relative to the premix flame, i.e. relative to the backflow zone forming in the plane of the outlet cross section of the mixing section, depends substantially on how far the hot gases from the combustion can flow back into these recirculation zones in the course of operation and can maintain the feeding there to form a self-igniting combustion zone or at least a combustion zone burning in a stable manner. Especially in the transient ranges, starting, stopping, changing the operating parameters, etc., the backflow of the hot gases into the recirculation zones may take place irregularly, so that their effect on the outflowing mixture is repressed. In such a configuration, the stabilizing effect of the recirculation zones on the outflowing mixture is lost, whereupon extremely detrimental flame extinction and deflagrations may occur.

SUMMARY OF THE INVENTION

Accordingly, one object of the invention, as defined in the claims, is to provide in a combustion chamber of the type mentioned at the beginning novel measures which ensure stabilization of the premix flame in terms of combustion throughout the entire operation, which stabilization is effective over all load ranges.

A portion of the air/fuel mixture formed in the mixing section is branched off at the end of the latter and is intermixed in the outer recirculation zones. The location of this intermixing is selected in such a way that complete mixing of that portion of the branched off mixture inside the outer recirculation zones with the hot-gas flow recirculating there from the combustion is achieved inside the combustion chamber before the outer recirculation zones come into contact with the rest of the air/fuel mixture from the mixing section. This ensures that an advantageous mixing ratio of air/fuel mixture and hot gas is established in the recirculation zones, and the branched off air/fuel mixture, like a self-igniting pilot flame, substantially improves the stability of the flame front.

The subdividing of the air/fuel mixture from the mixing section into a main flow and a secondary flow subdivided into small partial flows produces inside the combustion space a greatly enlarged contact area between the air/fuel mixture and the recirculating hot gas.

So that the velocity of the air/fuel mixture generally remains approximately constant and so that a flashback of the flame is avoided, the overall cross-sectional area of main flow and secondary flow of the air/fuel mixture is kept approximately constant. This is achieved by a small contraction being provided at the end of the mixing section. In addition, in order to achieve this aim, the number of branches for the partial flow, the respective cross section of flow and the directing of the flow are influenced to the appropriate extent.

The essential advantages of the invention may be seen in the fact that a) lower, lean extinction limits and thus a widened operating range of lean premix burners are obtained;

b) improved flame stability, i.e. smaller pressure pulsations result;

c) reduced burn-out length is achieved by intensifying the outer reaction front.

The reason for the advantage under a) may be seen in the fact that, compared with conventional mixing by shearing layers between air/fuel mixture and recirculating hot gas, which mixing leads to a maximum of the probability density distribution of the volumetric ratio between the two said media at around 50%, the measure according to the invention for the admixing of the air/fuel mixture to the outer recirculation zones ensures such a distribution at around 30%. With the aid of measurements over the correlated self-ignition times at the different probability density distributions for the different media, it has been found that, with a distribution of air/fuel mixture inside the outer recirculation zones which has a maximum at 30%, the ignition delay time turns out to be one order of magnitude smaller than that with a distribution which has a maximum at 50%.

Advantageous and expedient developments of the achievement of the object according to the invention are defined in the further claims.

BRIEF DESCRIPTION OF THE DRAWING

A more complete appreciation of the invention and many of the attendant advantages thereof will be readily obtained as the same becomes better understood by reference to the following detailed description when considered in connection with the accompanying drawing, wherein the single FIGURE shows a combustion chamber which comprises a mixing section with an adjoining combustion space.

DESCRIPTION OF THE PREFERRED EMBODIMENT

Referring now to the drawing, wherein all elements not required for directly understanding the invention have been omitted and the direction of flow of the media is indicated by arrows, the FIGURE, as apparent from the schematically depicted axis 15, shows a combustion chamber which is designed as an annular combustion chamber 1 and essentially comprises a continuous annular or quasi-annular cylinder. However, the combustion chamber may also comprise a number of individually self-contained combustion spaces arranged axially, quasi-axially or helically around the said axis. A combustion chamber which comprises a single combustion space in the form shown is also possible. The present annular combustion chamber 1 is arranged downstream of a mixing section 2, in which case this mixing section may easily be part of a premix burner as described, for example, in U.S. Pat. No. 4,932,861 to Keller et al. This publication is therefore declared to be an integral part of this description. Of course, the mixing section 2 which is apparent from the FIGURE and from which a swirl flow is provided may be part of a mixing tube which acts, for example, downstream of the said premix burner. In principle, the concern here specifically or broadly is to form within this mixing section 2 an air/fuel mixture for the subsequent combustion in such a way that this combustion then takes place with miminized pollutant emissions, in particular as far as the NOx emissions are concerned. A combustion space 3 adjoins the end of the mixing section 2 in such a way that the transition between the two flow sections is formed by a radial jump 5 in cross section, which first of all induces the cross section of flow of the combustion space 3, this cross section of flow being 2 to 10 times the outlet cross section of the mixing section 2. A flame front appears in the plane of this jump 5 in cross section as a result of the breakdown of the swirl flow already mentioned, which flame front is characterized by a backflow zone 12. The latter in fact forms a bodiless flame retention baffle, which, in addition to the outer recirculation zones, helps to stabilize the flame front 20. Fluidic outer recirculation zones 10 form in the region of the jump 5 in cross section during operation, in which recirculation zones 10 vortex separations 11 arise due to the vacuum prevailing there, which vortex separations 11 are in fact suitable for ensuring annular stabilization of the backflow zone 12, and thus consequently of the flame front. It is therefore of the utmost importance that the vortex separations 11 remain stable during the entire operation. For this purpose, a portion 9 of the entire air/fuel mixture 8 is branched off at the transition between the mixing section 2 and the combustion space 3 and is intermixed in the outer recirculation zones 10. This branched off portion 9 of preferably 10–30% of the entire mixture 8 is introduced into the said outer recirculation zones 10 via flow passages 4, the location of the intermixing being selected in such a way that complete mixing of the portion 9 with a recirculating hot gas 17 is achieved in the region of the vortex separations 11 before the outer recirculation zones 10 come into contact with the main flow 16 of the air/fuel mixture 8. This ensures that an advantageous mixing ratio of air/fuel mixture 9 and hot gas is generally established in the outer recirculation zones 10, and the branched off mixture 9, like a self-igniting pilot flame, substantially improves the stability of the flame front 20, i.e. of the premix flame. The subdividing of the entire air/fuel mixture 8 into a main flow 16 and a secondary flow 9 subdivided into small partial flows results in a greatly enlarged contact area between the air/fuel mixture and the recirculating hot gas 17. So that the velocity of the air/fuel mixture remains approximately constant and so that a flashback of the flame is avoided, the overall cross-sectional area of main flow 16 and secondary flow 9 is also to be kept approximately constant. This is achieved in a regulating manner in the sense that an appropriately sized contraction 7 of the flow is provided at the end of the mixing section 2. The diameter of the flow passages 4, which run approximately at an angle of 30°–60°, preferably 45°, relative to the shaft axis 15 so that they run approximately parallel to the wall flow lines of the swirl flow, is 3–8%, preferably 5%, of the hydraulic diameter of the mixing section 2. The number of flow passages 4 results from the mass flow ratio between main flow and secondary flow of the air/fuel mixture, the mass flow ratio corresponding approximately to the surface ratio of the two flows. The distance between the flow passages 4 and the mixing section is preferably about 10% of the hydraulic diameter of the mixing section 2. The air/fuel mixture 9 via the flow passages 4 can be enriched with an additional fuel 6 by the said fuel 6 being introduced in each flow passage 4, for example via a circular line 19 provided with bores 18, as a result of which an intensified and reliable pilot flame acts in the outer recirculation zones 10, this allowing a low, lean extinction limit to be aimed at even in the transient ranges at minimized pollutant emissions and therefore the operating range of lean premix burners can also be extended to load ranges below 40% . It only remains to say that the hot gases 13 are admitted to a downstream turbine 14 (not shown in any more detail), in which case the combustion chamber 1 shown here can readily be arranged on the low-pressure side of a gas-turbine group constructed for sequential combustion and can be operated by a self-ignition method.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A combustion chamber for a gas-turbine group, comprising:

a combustion chamber wall defining a combustion space;

a mixing section for premixing an air/fuel mixture connected to deliver a premixed air/fuel flow to the combustion space, the mixing section having a cross section less than a cross section of the combustion space, the combustion chamber wall including a radially outwardly extending panel at a junction between the mixing section and the combustion space, wherein the premixed air/fuel flow exiting the mixing section and flowing into the combustion space induces a low pressure region in the combustion space at the radially outwardly extending panel to produce outer recirculation zones in the flow in the combustion space; and a plurality of flow ducts connected between the mixing section and the radially outwardly extending wall to remove a portion of the mixed air/fuel flow from the mixing section and guide the removed portion into the outer recirculation zones.

2. The combustion chamber as claimed in claim 1, wherein the combustion chamber is an annular combustion chamber.

3. The combustion chamber as claimed in claim 1, wherein the flow ducts between the mixing section and the outer recirculation zones are oriented at an angle of 30°–60° relative to a main flow direction.

4. The combustion chamber as claimed in claim 1, wherein the portion of the air/fuel mixture flowing through the flow ducts is 10–30% of an entire mixture.

5. The combustion chamber as claimed in claim 1, further comprising means for introducing additional fuel into the portion of the mixture flowing through the flow ducts.

6. The combustion chamber as claimed in claim 5, wherein said means for introducing additional fuel includes a circular fuel line connected to receive fuel from a fuel source and having bores connecting to the flow ducts.

7. The combustion chamber as claimed in claim 1, wherein the cross section of flow of the combustion space is 2 to 10 times the size of the cross section of the mixing section.

8. The combustion chamber as claimed in claim 1, wherein a diameter of each flow duct is 3–8% of a hydraulic diameter of the mixing section.

9. The combustion chamber as claimed in claim 1, wherein an end phase of the mixing section is shaped with a narrowing cross-sectional contraction region which connects to the combustion space.

10. The combustion chamber as claimed in claim 1, wherein the flow ducts branch off from the contraction region of the mixing section.

* * * * *